US008883890B2

(12) United States Patent
Sekiya et al.

(10) Patent No.: US 8,883,890 B2
(45) Date of Patent: Nov. 11, 2014

(54) CREPE AGENT COMPOSITION AND METHOD FOR PRODUCING CREPE PAPER

(75) Inventors: Hiroshi Sekiya, Tokyo (JP); Daisuke Kurihara, Tokyo (JP); Hiraku Sawada, Shizuoka (JP); Masayuki Serizawa, Shizuoka (JP)

(73) Assignee: Maintech Co., Ltd., Chiyoda-Ku, Tokyo (JP)

( * ) Notice: Subject to any disclaimer, the term of this patent is extended or adjusted under 35 U.S.C. 154(b) by 357 days.

(21) Appl. No.: 12/998,408

(22) PCT Filed: Oct. 16, 2009

(86) PCT No.: PCT/JP2009/005429

§ 371 (c)(1), (2), (4) Date: Apr. 14, 2011

(87) PCT Pub. No.: WO2010/044280

PCT Pub. Date: Apr. 22, 2010

(65) Prior Publication Data

US 2011/0198776 A1 Aug. 18, 2011

(30) Foreign Application Priority Data

Oct. 16, 2008 (JP) ..... 2008-267131

(51) Int. Cl.

| | |
|---|---|
| ***C08K 3/34*** | (2006.01) |
| ***C08K 3/38*** | (2006.01) |
| ***C08K 5/3492*** | (2006.01) |
| ***D21H 27/00*** | (2006.01) |
| ***D21H 21/14*** | (2006.01) |
| ***D21H 19/16*** | (2006.01) |

(52) U.S. Cl.

CPC ..... *D21H 19/16* (2013.01); *D21H 27/002* (2013.01); *D21H 21/146* (2013.01)

USPC ..... 524/101; 524/404; 524/443

(58) Field of Classification Search

USPC ..... 524/404, 101, 443

See application file for complete search history.

(56) References Cited

U.S. PATENT DOCUMENTS 6,454,901 B1 9/2002 Sekiya et al.

FOREIGN PATENT DOCUMENTS

| | | |
|---|---|---|
| JP | 06-280181 | 10/1994 |
| JP | 11-217534 | 8/1999 |
| JP | 11-512498 | 10/1999 |
| JP | 2001-064897 | 3/2001 |
| WO | WO 97/11223 | 3/1997 |

*Primary Examiner* — Kriellion Sanders

(74) *Attorney, Agent, or Firm* — Flynn, Thiel, Boutell & Tanis, P.C.

(57) ABSTRACT

A crepe agent composition that forms a layer having excellent durability and a method for producing a crepe paper using the same. The crepe agent composition is to be applied to a surface of a cylindrical dryer, and contains an inorganic solid lubricant, a dispersant for dispersing the inorganic solid lubricant, a thermosetting polymer for fixing the inorganic solid lubricant to the surface of the cylindrical dryer, and water as a solvent, the inorganic solid lubricant having a particle diameter of 0.5 to 20 μm.

10 Claims, 8 Drawing Sheets

CREPE AGENT COMPOSITION AND METHOD FOR PRODUCING CREPE PAPER

TECHNICAL FIELD

The present invention relates to a crepe agent composition and a method for producing a crepe paper.

BACKGROUND ART

A crepe paper P2 having crepes, such as tissue paper or toilet paper, is produced by pressing a paper body P1 against the surface of a heated cylindrical dryer Y so that the paper body P1 adheres thereto, followed by certain drying, and then stripping the paper body P1 off the cylindrical dryer Y by a doctor blade D (see FIG. 8).

Here, in order to form a high-quality crepe paper, the adhesion and strippability of the paper body (crepe paper) to and from the heated cylindrical dryer are important, and the degrees thereof greatly influence the crepe configuration.

Incidentally, in recent years, pulps used for crepe papers have been diversified, including wet pulp, dry pulp, flow pulp, etc. In particular, for the purpose of cost reduction, a short-fiber L material is often used.

Further, the final moisture content of a product is also often increased.

From these reasons, the moisture content of the wet paper pressed against a cylindrical dryer is increased, whereby the formed layer is partially dissolved in some parts. In addition, a softening agent and the like are often added for the purpose of quality improvement, and thus there is a possibility that the formed layer is partially dissolved by the softening agent and the like.

In response to this, attempts have been made to improve the strippability of a paper body by applying a crepe agent and a thermosetting polymer to a cylindrical dryer to form a layer on the surface of the cylindrical dryer.

For example, a crepe agent obtained by reacting polyamide polyamine with epichlorohydrin, and then reacting the same with an inorganic acid, an organic acid, a monoamine compound, or a monomercapto-group-containing compound is known (see, e.g., Patent Document 1).

Further, a crepe agent composition containing a water-soluble polymer and a phosphoric-acid-based stabilizer is known (see, e.g., Patent Document 2).

Also, the present inventors have previously invented a crepe agent composition containing molybdenum disulfide (see e.g., Patent Document 3).

According to such an invention, the adhesion and strippability of a paper body to and from a cylindrical dryer are improved to a certain degree.

PRIOR ART DOCUMENTS

Patent Documents

Patent Document 1: Japanese Patent Application Laid-Open Publication No. 02-127597

Patent Document 2: Japanese Unexamined Patent Application Publication Translation of PCT Application No. 2002-522632

Patent Document 3: Japanese Patent No. 3304318

SUMMARY OF THE INVENTION

Problems that the Invention Solve

However, in the crepe agent of Patent Document 1 and the crepe agent composition described in Patent Document 2 or 3, the lubricity of the formed layer is insufficient. Accordingly, the adhesion and stripability of a crepe paper are insufficient, resulting in a small number of crepes, whereby the quality of the crepe paper deteriorates.

Further, when the lubricity is insufficient, the formed layer is likely to be shaved due to abrasion with a doctor blade.

Furthermore, in the case where the sliding properties between a cylindrical dryer and a doctor blade deteriorate, the doctor blade may cause a stick-slip phenomenon, resulting in the formation of chatter marks.

In addition to this, in recent years, as mentioned above, pulps used for crepe papers have been diversified, including wet pulp, dry pulp, flow pulp, etc., so there is a possibility that the formed layer is partially dissolved by moisture, a softening agent, and the like contained therein.

In this case, the durability of the (crepe) layer is insufficient. Therefore, so-called metal touch, where the doctor blade directly touches the cylindrical dryer, may occur, whereby a flaw called scratching is formed in the cylindrical dryer in some cases, causing paper breakage or kakare (a phenomenon where a hole is formed in the paper).

The present invention was accomplished in view of the above background. An object of the invention is to provide a crepe agent composition that forms a layer having excellent lubricity and durability, and also a method for producing a crepe paper, which is capable of producing a crepe paper with excellent quality.

Means for Solving the Problems

The present inventors conducted extensive research to solve the above problems. As a result, they found that the problems mentioned above can be solved by using, as a component of a crepe agent composition, a lubricant including an inorganic solid lubricant and/or organic solid lubricant having a predetermined particle diameter. They thus accomplished the invention.

Specifically, the invention consists in (1) a crepe agent composition for being applied to a surface of a cylindrical dryer, comprising a lubricant including an organic solid lubricant and/or inorganic solid lubricant, a dispersant for dispersing the lubricant, a thermosetting polymer for fixing the lubricant to the surface of the cylindrical dryer, and water that is a solvent, the lubricant having a particle diameter of 0.5 to 20 μm.

The invention consists in (2) a crepe agent composition according to the (1) above, wherein the lubricant and the thermosetting polymer each contain a nitrogen atom.

The invention consists in (3) a crepe agent composition according to the (1) above, wherein the lubricant is white.

The invention consists in (4) a crepe agent composition according to the (1) above, wherein the inorganic solid lubricant is boron nitride or silicon nitride.

The invention consists in (5) a crepe agent composition according to the (1) above, wherein the organic solid lubricant is melamine cyanurate.

The invention consists in (6) a crepe agent composition according to the (1) above, wherein the thermosetting polymer is at least one kind selected from the group consisting of polyamide polyamine epichlorohydrin, polyamine epichlorohydrin, silyl-linked joint polyamide polyamine, polyvinylamine, polyethyleneimine, polyacrylamide, and polymethacrylamide.

The invention consists in (7) a crepe agent composition according to the (1) above, wherein the crepe agent composition includes the lubricant in an amount of 0.1 to 5.0 mass %, the dispersant in an amount of 0.01 to 1.0 mass %, and the thermosetting polymer in an amount of 0.1 to 30 mass %.

The invention consists in (8) a crepe agent composition according to the (2) above, wherein the dispersant contains a nitrogen atom.

The invention consists in (9) a crepe agent composition according to the (1) above, wherein the lubricant is an inorganic solid lubricant, the crepe agent composition includes the inorganic solid lubricant in an amount of 0.1 to 1.0 mass %, the dispersant in an amount of 0.01 to 0.2 mass %, and the thermosetting polymer in an amount of 0.1 to 30 mass %, and the proportions of the inorganic solid lubricant and the thermosetting polymer are in a mass ratio of 1:10 to 150.

The invention consists in (10) a crepe agent composition according to the (1) above, wherein the lubricant is an organic solid lubricant, the crepe agent composition includes the organic solid lubricant in an amount of 0.1 to 5.0 mass %, the dispersant in an amount of 0.01 to 1.0 mass %, and the thermosetting polymer in an amount of 0.1 to 30 mass %, and the proportions of the organic solid lubricant and the thermosetting polymer are in a mass ratio of 1:2 to 30.

The invention consists in (11) a crepe agent composition according to the (1) above, wherein the lubricant is an organic solid lubricant and an inorganic solid lubricant, the crepe agent composition includes the organic solid lubricant in an amount of 0.1 to 5.0 mass %, the inorganic solid lubricant in an amount of 0.1 to 1.0 mass %, the dispersant in an amount of 0.02 to 1.2 mass %, and the thermosetting polymer in an amount of 0.1 to 30 mass %, and the proportions of the organic solid lubricant and the inorganic solid lubricant are in a mass ratio of 1 to 10:1.

The invention consists in (12) a method for producing a crepe paper, wherein a paper body adhering to a surface of a cylindrical dryer that rotates is stripped off the cylindrical dryer by a doctor blade and used as a crepe paper, the method comprising successively feeding and applying a crepe agent composition to the surface of the cylindrical dryer, with the paper body being fed to the cylindrical dryer.

Also, as long as an object of the invention is accompanied, a configuration where the (1) to (12) above are suitably combined is also applicable.

Advantage of the Invention

In the crepe agent composition of the invention, the crepe agent composition is applied to the surface of a cylindrical dryer and heated, whereby the thermosetting polymer is cured, forming a layer on the surface (hereinafter referred to as "crepe layer").

At this time, the crepe agent composition contains the lubricant including an inorganic solid lubricant and/or organic solid lubricant having a predetermined particle diameter, and thus the lubricity of the crepe layer is improved.

As a result, the decomposition of the crepe layer due to frictional heat between a doctor blade and the crepe layer is also suppressed, and thus the durability of the crepe layer is also improved.

Further, in the case where the crepe agent composition contains an organic solid lubricant, the ingress of moisture is suppressed while maintaining lubricity. In particular, in the case where an organic solid lubricant having a predetermined particle diameter is contained, the ingress of moisture is further suppressed while maintaining lubricity. Accordingly, the durability of the crepe layer can be further improved.

In the crepe agent composition of the invention, when the lubricant and the thermosetting polymer each contain a nitrogen atom, their compatibility with each other is excellent, and thus the lubricant is uniformly dispersed.

Further, in the crepe layer, the lubricant is uniformly dispersed and immobilized. Also, it is preferable that the dispersant also contains a nitrogen atom. In this case, the dispersion stability of the lubricant is further improved.

In the crepe agent composition of the invention, in the case where the lubricant is white, even when a small amount of the crepe agent composition adheres, such a crepe agent composition is not noticeable. That is, the visual quality is improved. Also, each component of the crepe agent composition has no problems in terms of safety and functionality even when it adheres to a crepe paper.

In the crepe agent composition of the invention, when the lubricant is an inorganic solid lubricant, and the proportions of the inorganic solid lubricant and the thermosetting polymer are in a mass ratio of 1:10 to 150, the kinetic frictional force is small, resulting in improved lubricity.

Further, when the lubricant is an organic solid lubricant, and the proportions of the organic solid lubricant and the thermosetting polymer are in a mass ratio of 1:2 to 30, the kinetic frictional force is small, resulting in improved lubricity.

Furthermore, when the lubricant is an organic solid lubricant and an inorganic solid lubricant, and the proportions of the organic solid lubricant and the inorganic solid lubricant are in a mass ratio of 1 to 10:1, the kinetic frictional force is small, resulting in improved lubricity.

The method of the invention for producing a crepe paper uses the crepe agent composition mentioned above, and thus is capable of producing a crepe paper with a large number of crepes. Therefore, it can be said that the method of the invention for producing a crepe paper provides excellent productivity together with improved quality.

BEST MODE FOR CARRYING OUT THE INVENTION

Figure 1:
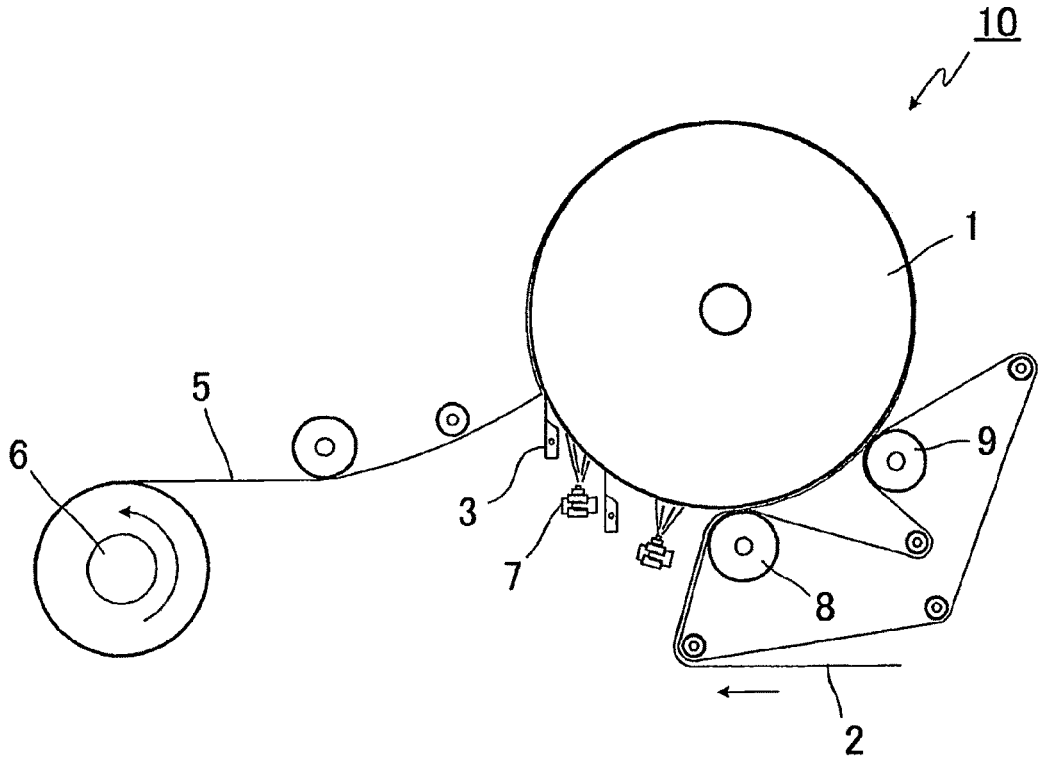
FIG. 1 is a front view showing an embodiment of a production apparatus in the method for producing a crepe paper according to the invention.

Hereinafter, preferred embodiments of the invention will be described in detail with reference to the drawings if desired. Also, in the drawings, the same components are indicated by the same reference numerals, and redundant explanations are omitted. Further, unless otherwise noted, the positional relationships, such as up, down, right, and left, are based on the positional relationships shown in the drawings. Furthermore, the dimensional ratios in the drawings are not limited to the shown ratios.

The crepe agent composition of the invention includes a lubricant, a dispersant, and a thermosetting polymer.

Further, it is preferable that the lubricant, the dispersant, and the thermosetting polymer each contain a nitrogen atom. In this case, their compatibility with one another is excellent, and thus the dispersion stability of the lubricant is improved.

Further, in this case, in the crepe layer, the lubricant is uniformly dispersed and immobilized. Accordingly, even when a cylindrical dryer has a scratch, such a scratch can be compensated for, whereby a uniform crepe layer can be formed.

In the crepe agent composition, it is preferable that the inorganic solid lubricant and the organic solid lubricant are both white. In this case, even when a small amount of the crepe agent composition adheres to a crepe paper or the like, such a crepe agent composition is not noticeable. That is, the visual quality is improved.

It is preferable that the crepe agent composition includes the lubricant in an amount of 0.1 to 5.0 mass %, the dispersant in an amount of 0.01 to 1.0 mass %, and the thermosetting polymer in an amount of 0.1 to 30 mass %. In this case, the storage stability of the crepe agent composition is improved. That is, the dispersed inorganic solid lubricant is unlikely to precipitate. Further, when a crepe layer is formed, the durability is reliably improved.

First Embodiment

Next, a first embodiment of the crepe agent composition of the invention will be described.

A crepe agent composition according to the first embodiment comprises a lubricant including an inorganic solid lubricant and/or organic solid lubricant, a dispersant for dispersing the lubricant, a thermosetting polymer for fixing the inorganic solid lubricant to the surface of a cylindrical dryer, and water that is a solvent.

Hereinafter, the inorganic solid lubricant, the organic solid lubricant, the dispersant, and the thermosetting polymer will be described in detail. Also, water is used as a medium. The kind of water is not limited, and may be tap water, natural water, distilled water, pure water, ion water, industrial water, or the like.

(Inorganic Solid Lubricant)

In the crepe agent composition according to the first embodiment, the inorganic solid lubricant is a hard solid made of an inorganic substance and having excellent heat resistance.

When the crepe agent composition contains the inorganic solid lubricant, the strength of the crepe layer is improved, and also the decomposition of the crepe layer due to frictional heat between a doctor blade and the crepe layer is suppressed. Further, the inorganic solid lubricant serves to physically fill depressions formed in the cylindrical dryer, such as scratches.

It is preferable that the inorganic solid lubricant is a compound containing a nitrogen atom, as mentioned above. In this case, a suppressive effect on the ingress of a softening agent and the like is also produced, and thus the outflow of the crepe layer caused by the softening agent and the like is suppressed.

Examples of such inorganic solid lubricants include boron nitride, silicon nitride, graphite fluoride, and the like.

Among these, it is preferable that the inorganic solid lubricant is boron nitride. In this case, the lubricity of the crepe layer can be further improved, and also the wear resistance of the doctor blade is further improved.

It is preferable that the inorganic solid lubricant is white. In this case, even when a small amount of the inorganic solid lubricant adheres to a crepe paper, such an inorganic solid lubricant is not noticeable. That is, the visual quality is improved. Also, each component of the crepe agent composition has no problems in terms of safety and functionality even when it adheres to a crepe paper.

Incidentally, boron nitride is white.

It is preferable that the inorganic solid lubricant has a particle diameter of 0.5 to 20 μm, and more preferably 1 to 10 μm.

When the particle diameter is less than 0.5 μm, the lubricity of the crepe layer is insufficient. That is, the durability-improving effect of the inorganic solid lubricant is not exhibited. Meanwhile, when the particle diameter exceeds 20 μm, the adhesiveness of the crepe layer to the cylindrical dryer is likely to decrease. Further, also as a crepe agent composition, the dispersibility in a medium (water) deteriorates. Accordingly, even when the crepe agent composition is applied, an uneven application is likely to be resulted.

It is preferable that the highest tolerable temperature of the inorganic solid lubricant is 500° C. or more. In this case, the decomposition of the crepe layer due to frictional heat between a doctor blade and the crepe layer can be reliably suppressed.

It is preferable that the inorganic solid lubricant has a friction coefficient of 0.002 to 0.30. In this case, lubricity can be reliably exhibited.

(Organic Solid Lubricant)

In the crepe agent composition according to the first embodiment, the organic solid lubricant is a soft solid made of an organic substance and having excellent water resistance.

When the crepe agent composition contains the organic solid lubricant, the ingress of moisture is suppressed while maintaining lubricity. Further, the organic solid lubricant is converted into a soft solid during heating, and thus it serves to fill a space between a depression formed in the cylindrical dryer and the inorganic solid lubricant.

Examples of such organic solid lubricants include melamine cyanurate, polytetrafluoroethylene (PTFE), perfluoro alkoxy alkane (PFA), perfluoroethylenepropene copolymer (FEP), ethylene-tetrafluoroethylene copolymer (ETFE), ethylene-chlorotrifluoroethylene copolymer (ECTFE), polyvinylidene fluoride (PVDF), polychlorotrifluoroethylene (PCTFE), and polyvinyl fluoride (PVF).

Among these, it is preferable that the organic solid lubricant is a compound containing a nitrogen atom, as mentioned above. That is, it is preferable that the organic solid lubricant is melamine cyanurate. In this case, a further suppressive effect on the ingress of moisture is produced. Accordingly, the outflow of the crepe layer caused by moisture is suppressed.

It is preferable that the organic solid lubricant is white. In this case, even when a small amount of the organic solid lubricant adheres to a crepe paper, such an inorganic solid lubricant is not noticeable. That is, the visual quality is improved. Also, each component of the crepe agent composition has no problems in terms of safety and functionality even when it adheres to a crepe paper.

It is preferable that the organic solid lubricant has a particle diameter of 0.5 to 20 μm, and more preferably 1 to 10 μm.

When the particle diameter is less than 0.5 μm, the lubricity of the crepe layer is insufficient. That is, the durability-improving effect of the organic solid lubricant is not exhibited. Meanwhile, when the particle diameter exceeds 20 μm, the adhesiveness of the crepe layer to the cylindrical dryer is likely to decrease. Further, also as a crepe agent composition, the dispersibility in a medium (water) deteriorates. Accordingly, even when the crepe agent composition is applied, an uneven application is likely to be resulted.

It is preferable that the highest tolerable temperature of the organic solid lubricant is 200° C. or more.

It is preferable that the organic solid lubricant has a friction coefficient of 0.002 to 0.30. In this case, lubricity can be reliably exhibited.

(Dispersant)

In the crepe agent composition according to the first embodiment, the dispersant serves to disperse the inorganic solid lubricant and organic solid lubricant mentioned above. Further, in some cases, it also serves to disperse the thermosetting polymer mentioned below.

The dispersant is not limited, and may be a surfactant, a polymer, or the like, but is preferably an alcohol-based nonionic polymer or an amine- or ammonium-salt-based cationic polymer. Among these, the dispersant is more preferably a cationic polymer containing a nitrogen atom as mentioned above, and still more preferably an amine-based polymer. An example of such an amine-based polymer is a polyamine resin.

In the case where the inorganic solid lubricant and the organic solid lubricant contain a nitrogen atom, when the dispersant is an amine-based polymer, dispersibility is reliably improved.

(Thermosetting Polymer)

In the crepe agent composition according to the first embodiment, the thermosetting polymer is cured by the heat of the cylindrical dryer. Therefore, the thermosetting polymer exhibits the function of immobilizing the inorganic solid lubricant mentioned above to the surface of the cylindrical dryer.

Such a thermosetting polymer may be water-soluble or water-insoluble.

When the thermosetting polymer is water-soluble, it is dissolved in water, a solvent, and used. Meanwhile, when the thermosetting polymer is water-insoluble, it is dispersed in water, a solvent, and used.

Such a thermosetting polymer is not limited, and examples thereof include polyamide polyamine epichlorohydrin, polyamine epichlorohydrin, silyl-linked polyamide polyamine, polyvinyl alcohol, polyvinylamine, polyethyleneimine polyacrylamide, polymethacrylamide, polyacrylic acid, polymethacrylic acid, polyhydroxyethyl acrylate, polyhydroxyethyl methacrylate, poly-N-vinylpyrrolidinone, polyethylene oxide, hydroxyethyl cellulose, hydroxypropyl cellulose, guar gum, starch, agar, chitosan, alginic acid, and carboxymethyl cellulose.

Also among these, the thermosetting polymer is preferably at least one kind selected from the group consisting of polyamide polyamine epichlorohydrin, polyamine epichlorohydrin, silyl-linked polyamide polyamine, polyvinylamine, polyethyleneimine polyacrylamide, and polymethacrylamide, and more preferably polyamide polyamine epichlorohydrin or polyamine epichlorohydrin.

In this case, the heat resistance and durability of the crepe layer are still further improved.

In the crepe agent composition according to the first embodiment, it is preferable that the proportions of the organic solid lubricant and the inorganic solid lubricant are in a mass ratio of 1 to 10:1. That is, it is preferable that the organic solid lubricant is contained in an amount of 1 to 10 mass % per mass % of the inorganic solid lubricant. In this case, the kinetic frictional force is small, resulting in further improved lubricity. Accordingly, the replacement of a doctor blade can be delayed, and productivity is also improved.

It is preferable that the crepe agent composition according to the first embodiment includes the organic solid lubricant in an amount of 0.1 to 5.0 mass %, the inorganic solid lubricant in an amount of 0.1 to 1.0 mass %, the dispersant in an amount of 0.02 to 1.2 mass %, and the thermosetting polymer in an amount of 0.1 to 30 mass %. In this case, the storage stability of the crepe agent composition is improved. That is, the dispersed inorganic solid lubricant is unlikely to precipitate. Further, when a crepe layer is formed, the durability is reliably improved.

The crepe agent composition according to the first embodiment is fed and applied in fixed amounts to the surface of the cylindrical dryer. Accordingly, the thermosetting polymer is cured by the heat of the cylindrical dryer, whereby the organic solid lubricant and the inorganic solid lubricant are fixed to the surface, and a crepe layer having excellent lubricity is also formed. As a result, the surface of the cylindrical dryer is made flat and smooth. Also, in the case where the cylindrical dryer is broken, whereby minute depressions are formed in the surface, the inorganic solid lubricant and the organic solid lubricant are efficiently embedded into the depressions.

Further, the decomposition of the crepe layer due to frictional heat between a doctor blade and the crepe layer is also suppressed, and thus the durability of the crepe layer is also improved.

Then, after the crepe layer is formed, a doctor blade is pressed against the crepe layer in order to strip the paper body off the surface of the cylindrical dryer. At this time, because the crepe layer contains the lubricant, a lubricating action occurs between the doctor blade and the surface of the cylindrical dryer, resulting in improved durability.

Also, as the application of the crepe agent composition is continued, a new layer is formed to compensate for the abraded crepe layer.

As a result, no unevenness occurs in the crepe layer, and thus the adhesion and strippability of the crepe paper to and from the cylindrical dryer are improved. Therefore, it can be said that a method for producing a crepe paper using the crepe agent composition according to the first embodiment provides excellent productivity together with improved quality.

Incidentally, when the adhesion of the paper body to a cylindrical dryer is strong, after removal from the surface of a doctor blade, fine crepes (microfolds) are formed, while when the adhesion is weak, rough crepes (macrofolds) are formed. The more microfolds are formed, the more the quality of the crepe paper is improved, while the more macrofolds are formed, the more the quality of the crepe paper is decreased.

Further, when the strippability of the paper body from a cylindrical dryer is low, an over-adhesion phenomenon occurs, where the paper body is not removed from the surface of the cylindrical dryer and goes under the doctor blade. This will result in chips or flaws on the surface of the paper body, soiling of the surface of the cylindrical dryer due to the remaining paper body, etc. Also, this phenomenon is more prominent as the abrasion of the doctor blade proceeds.

In this way, in the field of crepe paper production, it is necessary to improve both the adhesion of a paper body to the surface of a cylindrical dryer and the strippability of the surface of a cylindrical dryer from a paper body.

Next, a method for producing the crepe agent composition according to the first embodiment will be described.

The crepe agent composition is produced by dispersing a lubricant using a dispersing machine. That is, first, an organic solid lubricant, an inorganic solid lubricant, a dispersant, a thermosetting polymer, and water are put into a dispersing machine, and dispersed for a predetermined period of time, followed by filtration and purification. A crepe agent composition according to the first embodiment is thus obtained. Also, the dispersing machine may be any of a roll mill, a ball mill, a colloid mill, a jet mill, a bead mill, and the like.

At this time, an additive may also be added into the dispersing machine in addition to the organic solid lubricant, the inorganic solid lubricant, the dispersant, the thermosetting polymer, and water.

Examples of such additives include stripping agents, softening agents, chelating agents, pH adjusters, antiseptic agents, viscosity adjusters, antiseptic agents, penetrating agents, and flame retardants.

Here, examples of the stripping agents include oils (mineral oil, synthetic oil, vegetable oil, animal oil, etc.). Specifically, polybdenum and paraffin wax are preferable.

Next, a method for producing a crepe paper using the crepe agent composition according to the first embodiment will be described.

FIG. 1 is a front view showing an embodiment of a production apparatus in the method for producing a crepe paper according to the invention.

As shown in FIG. 1, the method for producing a crepe paper according to the invention is implemented using a production apparatus 10.

The production apparatus 10 includes a cylindrical dryer 1 and pressing rollers 8 and 9 for pressing a paper body 2 against the surface of the cylindrical dryer 1, a doctor blade 3 to be pressed against the surface of the cylindrical dryer 1 for stripping the paper body 2 off the cylindrical dryer 1, a wind-up roller 6 for winding up a crepe paper 5 obtained by stripping off the paper body 2, and a spray nozzle 7 for feeding and applying the crepe agent composition mentioned above to the cylindrical dryer 1.

In the production apparatus 10, the paper body 2 is pressed by the pressing rollers 8 and 9 against the surface of the cylindrical dryer that rotates.

As a result, the paper body 2 adheres to the cylindrical dryer 1 and is heated at the same time.

The paper body 2 then turns into a crepe paper 5, is stripped off by the doctor blade 3, and then wound up by the wind-up roller 6.

The crepe paper 5 is thus produced.

Meanwhile, after the paper body 2 is stripped off by the doctor blade 3, a crepe agent composition is sprayed to the cylindrical dryer 1 by the spray nozzle 7. Also, in terms of minimizing adhesion to the paper body, it is preferable that the position of the spray nozzle 7 is behind the doctor blade 3.

At this time, it is preferable that the amount of the crepe agent composition sprayed is, as solids content, 0.1 μg to 100 $\mu g/m^2$.

When the amount spayed is less than 0.1 $\mu g/m^2$, as compared with the case where the amount spayed is within the above range, the crepe agent composition does not sufficiently adhere to the surface of the cylindrical dryer 1, whereby the amount of paper powder is relatively increased, and also the replacement cycle of the doctor blade 3 is likely to be longer. Further, when the amount spayed exceeds 100 $\mu g/m^2$, as compared with the case where the amount spayed is within the above range, there is a possibility that the excess is absorbed by the paper body.

When the crepe agent composition is sprayed onto the surface of the cylindrical dryer 1, the thermosetting polymer is cured by the heat of the cylindrical dryer 1, whereby a crepe layer containing the inorganic solid lubricant is formed.

Here, the formation of the crepe layer will be described in further detail.

Figure 2A:
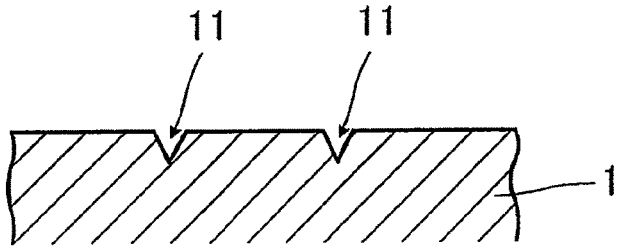
FIG. 2(*a*) is a schematic diagram showing the surface of a cylindrical dryer when a depression is formed in the cylindrical dryer in a method for producing a crepe paper according to a first embodiment, and FIG. 2(*b*) is a schematic diagram showing the surface of the cylindrical dryer after a crepe agent composition is applied to the cylindrical dryer of FIG. 2(*a*) to form a crepe layer.
Figure 2B:
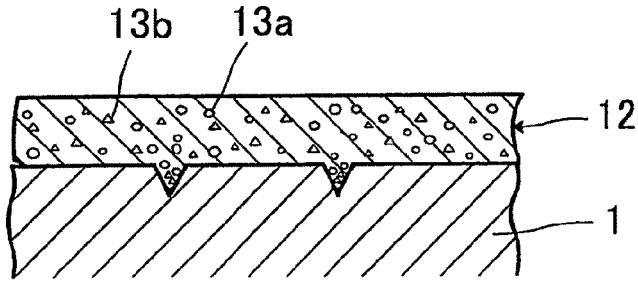

FIG. 2(*a*) is a schematic diagram showing the surface of a cylindrical dryer when a depression is formed in the cylindrical dryer in a method for producing a crepe paper according to a first embodiment, and FIG. 2(*b*) is a schematic diagram showing the surface of the cylindrical dryer after a crepe agent composition is applied to the cylindrical dryer of FIG. 2(*a*) to form a crepe layer.

As shown in FIG. 2(*a*), the cylindrical dryer 1 is worn away by the doctor blade 3 pressed against the surface thereof, forming minute depressions 11.

Then, when a crepe agent composition is applied to the cylindrical dryer 1, as shown in FIG. 2(*b*), a flat and smooth crepe layer 12 of about several microns is formed by heat and pressure.

The crepe layer 12 is configured such that an inorganic solid lubricant 13*a* and an organic solid lubricant 13*b* are dispersed in a cured thermosetting polymer 13 obtained by curing a thermosetting polymer.

Further, the depressions 11 in the cylindrical dryer 1 are filled with the inorganic solid lubricant 13*a* and the organic solid lubricant 13*b*. At this time, the hard inorganic solid lubricant 13*a* enters the depressions 11, while the space between the inorganic solid lubricant 13*a* and the depressions 11 is filled with the soft organic solid lubricant 13*b*, forming a firmer layer.

In this way, because the crepe layer 12 contains the inorganic solid lubricant 13*a* and organic solid lubricant 13*b* having a predetermined particle diameter, wear due to the doctor blade 3 is suppressed. Further, because the predetermined inorganic solid lubricant 13*a* and the organic solid lubricant 13*b* are used, the ingress of moisture, a softening agent, and the like can be prevented.

Further, because the depressions 11 are filled with the inorganic solid lubricant 13*a* and the organic solid lubricant 13*b*, the surface of the cylindrical dryer 1 is made flat and smooth, whereby the adhesion of the paper body is improved, and also the strippability is improved by the inorganic solid lubricant 13*a* and the organic solid lubricant 13*b*.

Accordingly, the method of the invention for producing a crepe paper provides a crepe paper with excellent productivity and excellent quality.

Second Embodiment

A crepe agent composition according to the second embodiment comprises a lubricant including an inorganic solid lubricant, a dispersant for dispersing the inorganic solid lubricant, a thermosetting polymer for fixing the inorganic solid lubricant to the surface of a cylindrical dryer, and water as a solvent. That is, the crepe agent composition according to the second embodiment is the same as the crepe agent composition according to the first embodiment, except that it includes no organic solid lubricant.

In the crepe agent composition according to the second embodiment, it is preferable that the proportions of the inorganic solid lubricant and the thermosetting polymer are in a mass ratio of 1:10 to 150. That is, it is preferable that the thermosetting polymer is contained in an amount of 10 to 150 mass % per mass % of the inorganic solid lubricant. In this case, the kinetic frictional force is small, resulting in further improved lubricity. Accordingly, the replacement of a doctor blade can be delayed, and productivity is also improved.

It is preferable that the crepe agent composition according to the second embodiment includes the inorganic solid lubricant in an amount of 0.1 to 1.0 mass %, the dispersant in an amount of 0.01 to 0.2 mass %, and the thermosetting polymer in an amount of 0.1 to 30 mass %. In this case, the storage stability of the crepe agent composition is improved. That is, the dispersed inorganic solid lubricant is unlikely to precipitate. Further, when a crepe layer is formed, the durability is reliably improved.

The crepe agent composition according to the second embodiment is fed and applied in fixed amounts to the surface of the cylindrical dryer. Accordingly, the thermosetting polymer is cured by the heat of the cylindrical dryer, whereby the inorganic solid lubricant is fixed to the surface, and a crepe layer having an excellent lubricity is also formed. As a result, the surface of the cylindrical dryer is made flat and smooth. Also, in the case where the cylindrical dryer is broken, whereby minute depressions are formed in the surface, the inorganic solid lubricant is efficiently embedded into the depressions.

Further, the decomposition of the crepe layer due to frictional heat between a doctor blade and the crepe layer is also suppressed, and thus the durability of the crepe layer is also improved.

Then, after the crepe layer is formed, a doctor blade is pressed against the crepe layer in order to strip the paper body off the surface of the cylindrical dryer. At this time, because the crepe layer contains the lubricant, a lubricating action occurs between the doctor blade and the surface of the cylindrical dryer, resulting in improved durability.

Also, as the application of the crepe agent composition is continued, a new layer is formed to compensate for the abraded crepe layer.

As a result, no unevenness occurs in the crepe layer, and thus the adhesion and strippability of the crepe paper to and from the cylindrical dryer are improved. Therefore, it can be said that a method for producing a crepe paper using the crepe agent composition according to the second embodiment provides excellent productivity together with improved quality.

The formation of the crepe layer will be described below.

Figure 3A:
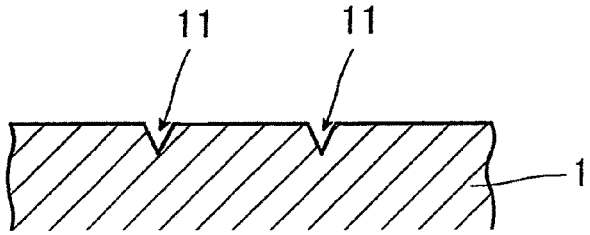
FIG. 3(*a*) is a schematic diagram showing the surface of a cylindrical dryer when a depression is formed in the cylindrical dryer in a method for producing a crepe paper according to a second embodiment, and FIG. 3(*b*) is a schematic diagram showing the surface of the cylindrical dryer after a crepe agent composition is applied to the cylindrical dryer of FIG. 3(*a*) to form a crepe layer.
Figure 3B:
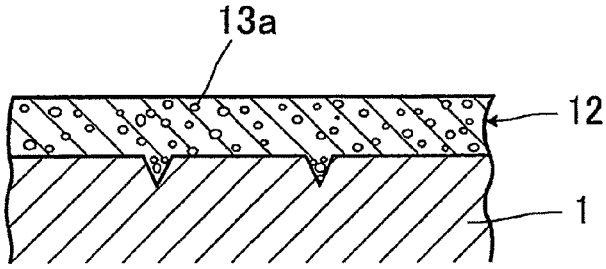

FIG. 3(*a*) is a schematic diagram showing the surface of a cylindrical dryer when a depression is formed in the cylindrical dryer in a method for producing a crepe paper according to a second embodiment, and FIG. 3(*b*) is a schematic diagram showing the surface of the cylindrical dryer after a crepe agent composition is applied to the cylindrical dryer of FIG. 3(*a*) to form a crepe layer.

As shown in FIG. 3(*a*), the cylindrical dryer 1 is worn away by the doctor blade 3 pressed against the surface thereof, forming minute depressions 11.

Then, when a crepe agent composition is applied to the cylindrical dryer 1, as shown in FIG. 3(*b*), a flat and smooth crepe layer 12 of about several microns is formed by heat and pressure.

The crepe layer 12 is configured such that an inorganic solid lubricant 13*a* is dispersed in a cured thermosetting polymer 13 obtained by curing a thermosetting polymer.

Further, the depressions 11 in the cylindrical dryer 1 are filled with the inorganic solid lubricant 13*a*.

In this way, because the crepe layer 12 contains the inorganic solid lubricant 13*a* having a predetermined particle diameter, wear due to the doctor blade 3 is suppressed.

Further, because the depressions 11 are filled with the inorganic solid lubricant 13*a*, the surface of the cylindrical dryer 1 is made flat and smooth, whereby the adhesion of the paper body is improved, and also the strippability is improved by the inorganic solid lubricant 13*a*.

Accordingly, the method of the invention for producing a crepe paper provides a crepe paper with excellent productivity and excellent quality.

Third Embodiment

A crepe agent composition according to the third embodiment comprises a lubricant including an organic solid lubricant, a dispersant for dispersing the organic solid lubricant, a thermosetting polymer for fixing the organic solid lubricant to the surface of a cylindrical dryer, and water as a solvent. That is, the crepe agent composition according to the third embodiment is the same as the crepe agent composition according to the first embodiment, except that it includes no inorganic solid lubricant.

In the crepe agent composition according to the third embodiment, it is preferable that the proportions of the organic solid lubricant and the thermosetting polymer are in a mass ratio of 1:2 to 30. That is, it is preferable that the thermosetting polymer is contained in an amount of 2 to 30 mass % per mass % of the organic solid lubricant. In this case, the kinetic frictional force is small, resulting in further improved lubricity. Accordingly, the replacement of a doctor blade can be delayed, and productivity is also improved.

It is preferable that the crepe agent composition according to the third embodiment includes the organic solid lubricant in an amount of 0.1 to 5.0 mass %, the dispersant in an amount of 0.01 to 1.0 mass %, and the thermosetting polymer in an amount of 0.1 to 30 mass %. In this case, the storage stability of the crepe agent composition is improved. That is, the dispersed inorganic solid lubricant is unlikely to precipitate. Further, when a crepe layer is formed, the durability is reliably improved.

The crepe agent composition according to the third embodiment is fed and applied in fixed amounts to the surface of the cylindrical dryer. Accordingly, the thermosetting polymer is cured by heat of the cylindrical dryer, whereby the organic solid lubricant is fixed to the surface, and a crepe layer having excellent lubricity is also formed. As a result, the surface of the cylindrical dryer is made flat and smooth. Also, in the case where the cylindrical dryer is broken, whereby minute depressions are formed in the surface, the organic solid lubricant is efficiently embedded into the depressions.

Further, the decomposition of the crepe layer due to frictional heat between a doctor blade and the crepe layer is also suppressed, and thus the durability of the crepe layer is also improved.

Then, after the crepe layer is formed, a doctor blade is pressed against the crepe layer in order to strip the paper body off the surface of the cylindrical dryer. At this time, because the crepe layer contains the lubricant, a lubricating action occurs between the doctor blade and the surface of the cylindrical dryer, resulting in improved durability.

Also, as the application of the crepe agent composition is continued, a new layer is formed to compensate for the abraded crepe layer.

As a result, no unevenness occurs in the crepe layer, and thus the adhesion and strippability of the crepe paper to and from the cylindrical dryer are improved. Therefore, it can be said that a method for producing a crepe paper using the crepe agent composition according to the third embodiment provides excellent productivity together with improved quality.

The formation of the crepe layer will be described below.

Figure 4A:
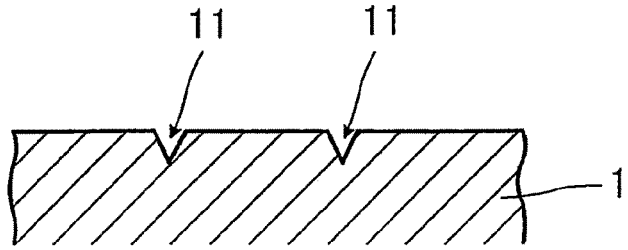
FIG. 4(*a*) is a schematic diagram showing the surface of a cylindrical dryer when a depression is formed in the cylindrical dryer in a method for producing a crepe paper according to a third embodiment, and FIG. 4(*b*) is a schematic diagram showing the surface of the cylindrical dryer after a crepe agent composition is applied to the cylindrical dryer of FIG. 4(*a*) to form a crepe layer.
Figure 4B:
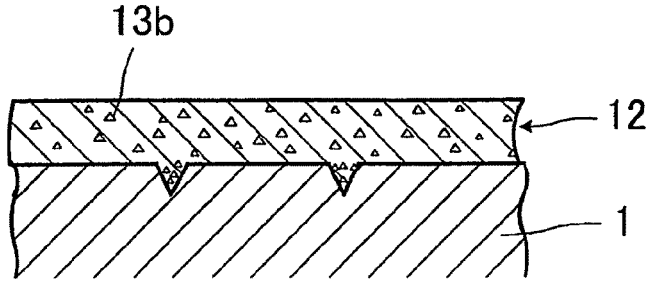

FIG. 4(*a*) is a schematic diagram showing the surface of a cylindrical dryer when a depression is formed in the cylindrical dryer in a method for producing a crepe paper according to a third embodiment, and FIG. 4(*b*) is a schematic diagram showing the surface of the cylindrical dryer after a crepe agent composition is applied to the cylindrical dryer of FIG. 4(*a*) to form a crepe layer.

As shown in FIG. 4(*a*), the cylindrical dryer 1 is worn away by the doctor blade 3 pressed against the surface thereof, forming minute depressions 11.

Then, when a crepe agent composition is applied to the cylindrical dryer 1, as shown in FIG. 3(*b*), a flat and smooth crepe layer 12 of about several microns is formed by heat and pressure.

The crepe layer 12 is configured such that an organic solid lubricant 13*b* is dispersed in a cured thermosetting polymer 13 obtained by curing a thermosetting polymer.

Further, the depressions 11 in the cylindrical dryer 1 are filled with the organic solid lubricant 13*b*.

In this way, because the crepe layer 12 contains the organic solid lubricant 13*b* having a predetermined particle diameter, wear due to the doctor blade 3 is suppressed.

Further, because the depressions 11 are filled with the organic solid lubricant 13*b*, the surface of the cylindrical dryer 1 is made flat and smooth, whereby the adhesion of the paper body is improved, and also the strippability is improved by the organic solid lubricant 13*b*.

Preferred embodiments of the present invention have been described above, but the invention is not limited to the above embodiments.

For example, although the crepe agent composition according to this embodiment includes a thermosetting polymer, it is also possible that it does not include a thermosetting polymer.

In this case, a thermosetting polymer is separately applied to a cylindrical dryer.

Further, although water is used as a solvent, it is also possible that an alcohol, an acid, or the like is added to water and used.

Although the crepe agent composition according to this embodiment is applied to the surface of a cylindrical dryer and used, it is also possible to apply the crepe agent composition to a honeycomb dryer, an air-through dryer, a belt-type dryer, a press roll, or the like of a paper-making machine.

EXAMPLES

Hereinafter, the present invention will be described in further detail based on Examples and Comparative Examples; however, the invention is not limited to the following examples.

Example 1

Polyamide polyamine epichlorohydrin (thermosetting polymer, product name: WS4020, manufactured by SEIKO PMC CORPORATION) 3 mass %, boron nitride (inorganic solid lubricant, particle diameter: 3.8 μm) 0.05 mass %, melamine cyanurate (organic solid lubricant, particle diameter: 1.1 μm) 1 mass %, a proper quantity of polyamine resin (dispersant) (10% by mass relative the total mass of the lubricants), and water were mixed, and dispersed using a dispersing machine to give a crepe agent composition.

Example 2

A crepe agent composition was obtained in the same manner as in Example 1, except that the proportion of boron nitride was 0.1 mass %.

Example 3

A crepe agent composition was obtained in the same manner as in Example 1, except that the proportion of boron nitride was 0.2 mass %.

Example 4

A crepe agent composition was obtained in the same manner as in Example 1, except that the proportion of boron nitride was 0.6 mass %.

Example 5

A crepe agent composition was obtained in the same manner as in Example 1, except that the proportion of boron nitride was 1 mass %.

Example 6

A crepe agent composition was obtained in the same manner as in Example 1, except that the proportion of boron nitride was 1.2 mass %.

Example 7

A crepe agent composition was obtained in the same manner as in Example 1, except that the proportion of polyamide polyamine epichlorohydrin was 1 mass %, and boron nitride was not used.

Example 8

A crepe agent composition was obtained in the same manner as in Example 7, except that the proportion of polyamide polyamine epichlorohydrin was 2 mass %.

Example 9

A crepe agent composition was obtained in the same manner as in Example 7, except that the proportion of polyamide polyamine epichlorohydrin was 3 mass %.

Example 10

A crepe agent composition was obtained in the same manner as in Example 7, except that the proportion of polyamide polyamine epichlorohydrin was 15 mass %.

Example 11

A crepe agent composition was obtained in the same manner as in Example 7, except that the proportion of polyamide polyamine epichlorohydrin was 30 mass %.

Example 12

A crepe agent composition was obtained in the same manner as in Example 7, except that the proportion of polyamide polyamine epichlorohydrin was 40 mass %.

Example 13

A crepe agent composition was obtained in the same manner as in Example 1, except that the proportion of polyamide polyamine epichlorohydrin was 1 mass %, the proportion of boron nitride was 0.2 mass %, and melamine cyanurate was not used.

Example 14

A crepe agent composition was obtained in the same manner as in Example 13, except that the proportion of polyamide polyamine epichlorohydrin was 2 mass %.

Example 15

A crepe agent composition was obtained in the same manner as in Example 13, except that the proportion of polyamide polyamine epichlorohydrin was 3 mass %.

Example 16

A crepe agent composition was obtained in the same manner as in Example 13, except that the proportion of polyamide polyamine epichlorohydrin was 15 mass %.

Example 17

A crepe agent composition was obtained in the same manner as in Example 13, except that the proportion of polyamide polyamine epichlorohydrin was 30 mass %.

Example 18

A crepe agent composition was obtained in the same manner as in Example 13, except that the proportion of polyamide polyamine epichlorohydrin was 40 mass %.

Example 19

A crepe agent composition was obtained in the same manner as in Example 1, except that polyoxyethylene alkyl ether (nonionic dispersant) was used in place of the polyamine resin (cationic dispersant).

Comparative Example 1

A crepe agent composition was obtained in the same manner as in Example 1, except that the proportion of polyamide polyamine epichlorohydrin was 30 mass %, and boron nitride and melamine cyanurate were not used.

Comparative Example 2

A crepe agent composition was obtained in the same manner as in Example 1, except that the proportion of polyamide polyamine epichlorohydrin was 3 mass %, and boron nitride and melamine cyanurate were not used.

Comparative Example 3

A crepe agent composition was obtained in the same manner as in Example 1, except that polyamide polyamine epichlorohydrin was not used, the proportion of boron nitride was 0.2 mass %, and the proportion of melamine cyanurate was 1 mass %.

Comparative Example 4

A crepe agent composition was obtained in the same manner as in Example 1, except that the polyamine resin was not used.

Evaluation

1. Tissue Paper Manufacturing Test

In the manufacture of tissue paper (crepe paper), the crepe agent compositions obtained in Examples 1 to 18 and Comparative Examples 1 to 3 were continuously sprayed to the surface of a cylindrical dryer under the following conditions: manufacturing rate: 1300 m/min, paper width: 4 m, basis weight of tissue paper: 17 g/m$^2$, amount of coating agent sprayed: 4 mg/m$^2$ (per unit area of the dryer). During the continuous spraying, when the doctor blade was broken, it was replaced with another doctor blade.

First, with respect to each of the crepe agent compositions of Examples 1 to 18 and Comparative Examples 1 to 3, the time until the doctor blade replacement was measured. The more the doctor blade replacement time is extended, the more preferable it is from a productivity point of view.

Next, 24 hours later, the produced tissue paper was measured for the number of crepes per unit area. The larger the number of crepes per unit area is, the more preferable it is in terms of quality.

Figure 5:
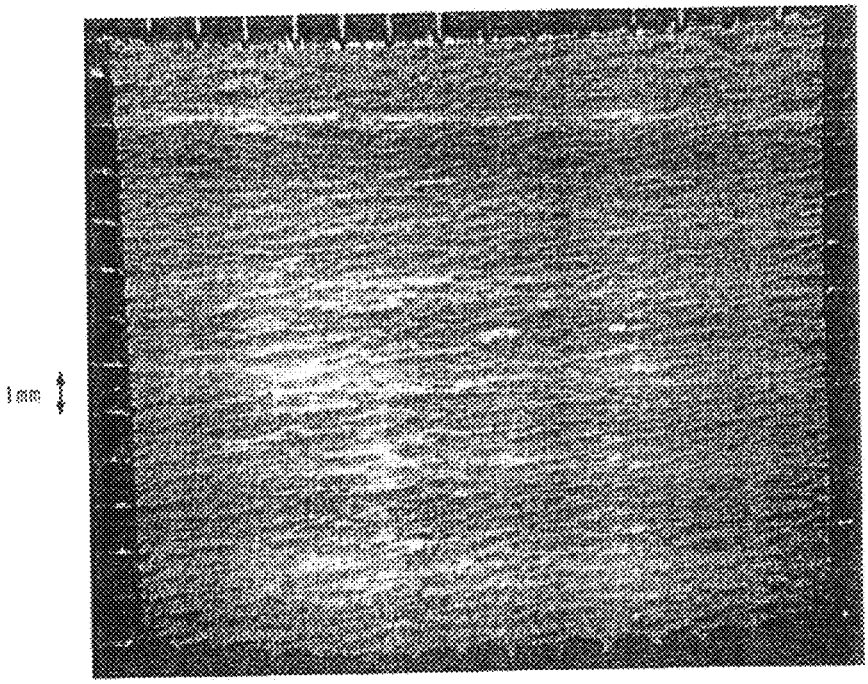
FIG. 5 is a photograph of a crepe paper manufactured using a crepe agent composition obtained in Example 1.
Figure 6:
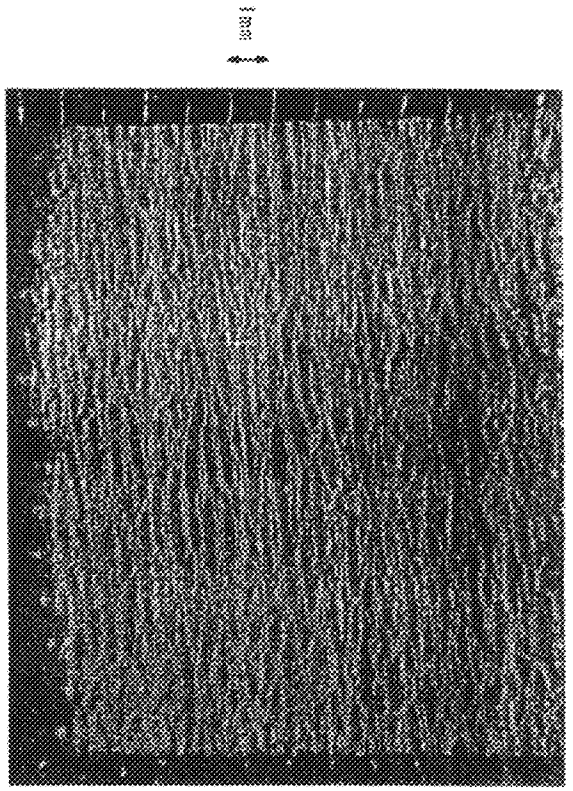
FIG. 6 is a photograph of a crepe paper manufactured using a crepe agent composition obtained in Comparative Example 1.

The obtained results are shown in Table 1. Further, FIG. 5 shows a photograph of a crepe paper manufactured using the crepe agent composition obtained in Example 1 (placed on a scale sheet), and FIG. 6 shows a photograph of a crepe paper manufactured using the crepe agent composition obtained in Comparative Example 1 (placed on a scale sheet).

2. Kinetic Frictional Force Measurement

Next, a test was carried out to confirm the effects of the functional composition of the invention on the reduction of kinetic frictional force.

Figure 7:
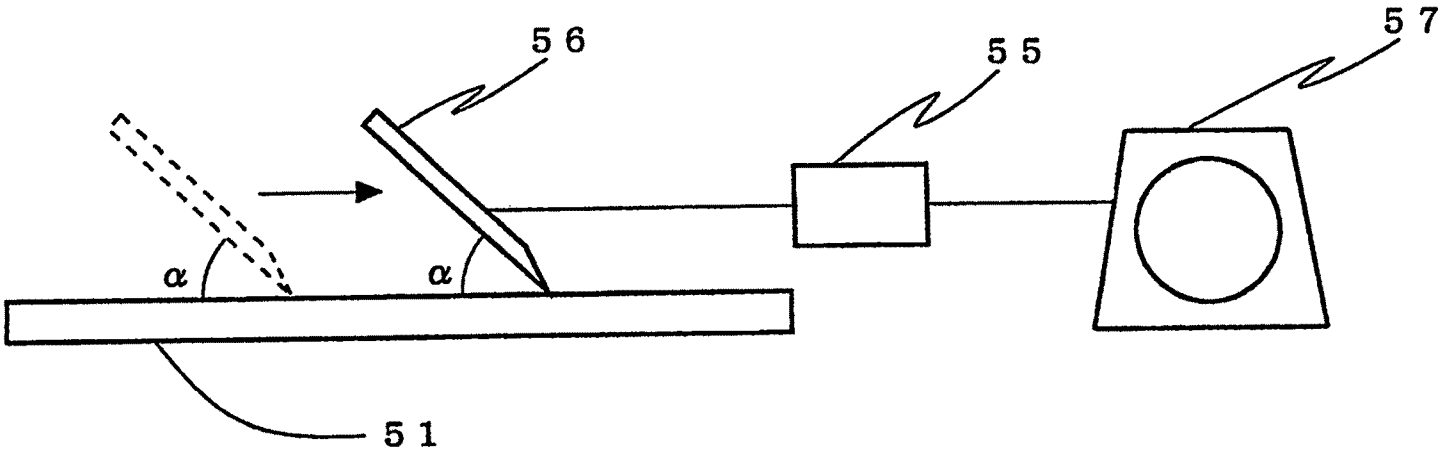
FIG. 7 is a diagram for explaining a method for measuring kinetic frictional force.
Figure 8:
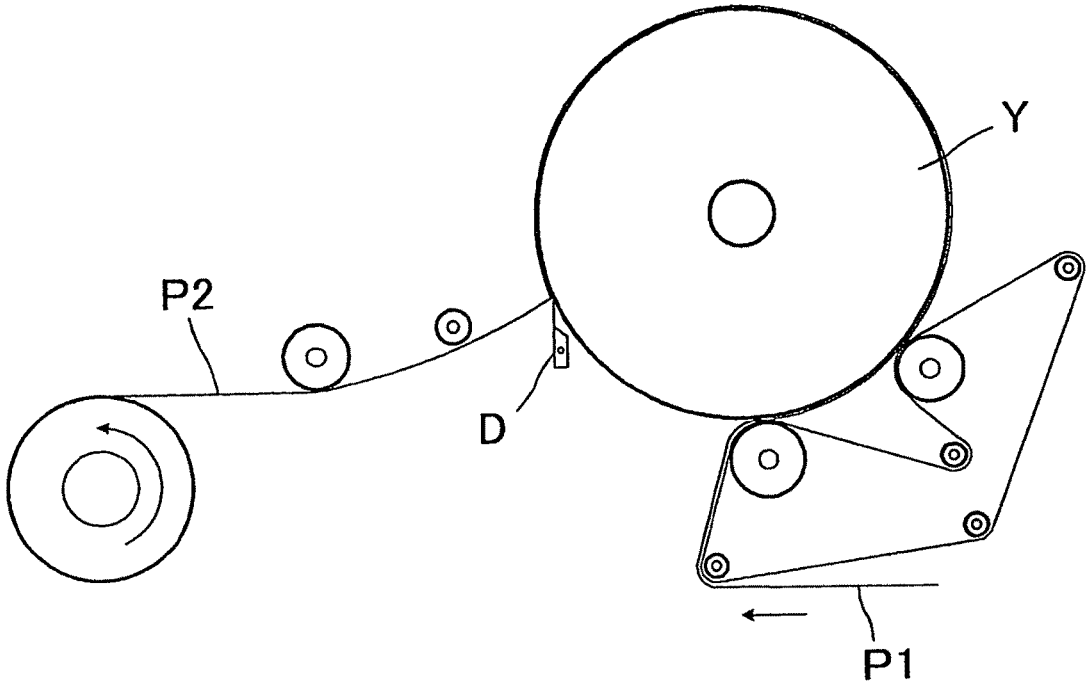
FIG.8 Prior Art
FIG. 8 is a front view showing an embodiment of a production apparatus in a conventional method for producing a crepe paper.

FIG. 7 is a diagram for explaining a method for measuring kinetic frictional force.

As shown in FIG. 7, the crepe agent compositions obtained in Examples 1 to 18 and Comparative Examples 1 to 3 were applied to the entire surface of a thermally sprayed ceramic plate 51, and they were then placed in a 110° C. thermostat to give crepe layers having a thickness of 0.5 mm.

Subsequently, a doctor blade 56 made of carbon set at a fixed angle ($\alpha$=30°) with the thermally sprayed ceramic plate 51 and a load cell 55 were connected with a wire, and also the load cell 55 and a motor 57 were connected with a wire.

Then, the load cell 55 was pulled by the motor 57. The kinetic frictional force exerted by the load cell 55 while the doctor blade 56 made of carbon slid on the thermally sprayed ceramic plate 51 was measured. The obtained results are shown in Table 1. Also, taking the kinetic frictional force in the case where only water was applied to the thermally sprayed ceramic plate 51 as 100, the kinetic frictional force of each example is shown in standard (relative value to blank).

TABLE 1

| | Number of Crepes (crepes/cm$^2$) | Doctor Replacement Time (hour) | Kinetic Frictional Force (g/cm) |
|---|---|---|---|
| Example 1 | 44 | 3 | 159.2 |
| Example 2 | 65 | 12 | 84.7 |
| Example 3 | 71 | 15.5 | 60.8 |
| Example 4 | 70 | 14 | 74.3 |
| Example 5 | 63 | 10.5 | 89.1 |
| Example 6 | 48 | 3.5 | 147.5 |
| Example 7 | 40 | 4 | 159.2 |
| Example 8 | 50 | 7 | 108.2 |
| Example 9 | 63 | 11 | 88.9 |
| Example 10 | 58 | 9 | 90.3 |
| Example 11 | 55 | 8.5 | 98.4 |
| Example 12 | 38 | 3 | 167.8 |
| Example 13 | 41 | 2.5 | 165.2 |
| Example 14 | 54 | 9 | 96.1 |

TABLE 1-continued

| | Number of Crepes (crepes/cm$^2$) | Doctor Replacement Time (hour) | Kinetic Frictional Force (g/cm) |
|---|---|---|---|
| Example 15 | 67 | 12 | 84.3 |
| Example 16 | 59 | 10.5 | 92.9 |
| Example 17 | 56 | 9 | 95.4 |
| Example 18 | 40 | 3 | 160.6 |
| Comparative Example 1 | 35 | 2 | 181.5 |
| Comparative Example 2 | 30 | 1.5 | 192.6 |
| Comparative Example 3 | 15 | 3 | 135.1 |

From the results in Table 1, it was confirmed that when a thermosetting polymer and a lubricant are contained, a crepe layer having lubricity can be formed, and also an extension of the replacement time can be provided by the excellent crepe conditions and the wear resistance of the doctor blade.

It was also shown that when the lubricant is an organic solid lubricant and an inorganic solid lubricant, it is preferable that the proportions of the organic solid lubricant and the inorganic solid lubricant are in a mass ratio of 1 to 10:1; when the lubricant is an inorganic solid lubricant, it is preferable that the proportions of the inorganic solid lubricant and the thermosetting polymer are in a mass ratio of 1:10 to 150; and when the lubricant is an organic solid lubricant, it is preferable that the proportions of the organic solid lubricant and the thermosetting polymer are in a mass ratio of 1:2 to 30. Also, in the case of the crepe agent composition of Comparative Example 3, no crepe layer was formed.

3. Hardness Examination

Using the crepe agent compositions obtained in Examples 3 and 19 and Comparative Examples 1 and 4, the hardness of coatings was examined.

First, each crepe agent composition was applied to a metal plate to give a thickness of 0.1 mm. Then, it was placed in a 110° C. thermostat to form a crepe layer, then removed from the thermostat, and allowed to cool for 10 minutes to give a sample.

A load was applied to the sample using a pencil having a sharpened end (6B, 5B, 4B, 3B, 2B, 1B, 1H, 2H, 3H, 4H, 5H, 6H, 7H, 8H). The pencils were slid on the surface of the crepe layer.

At this time, the hardness of the pencil that damaged the coating was measured. Of pencils, 6B is the softest, and 8H is the hardest.

The obtained results are shown in Table 2.

TABLE 2

| | Example 3 | Example 19 | Comparative Example 1 | Comparative Example 14 |
|---|---|---|---|---|
| Hardness of Pencil | 8H | 7H | 4H | 5H |

From the results in Table 2, it was shown that when an inorganic solid lubricant and an organic solid lubricant are contained, the hardness of a coating is increased, whereby a more stable coating can be formed. In particular, it was shown that when a dispersant containing a nitrogen atom is used, the hardness of a coating is further improved. Also, in Comparative Example 4, precipitation occurred in the crepe agent composition, and it was not possible to form a uniform coating.

From the above, it was confirmed that use of the crepe agent composition of the invention improves the durability of the formed layer.

INDUSTRIAL APPLICABILITY

The crepe agent composition of the invention is, in the manufacture of a crepe paper, applied to a cylindrical dryer and used. According to the crepe agent composition of the invention, the formed layer has excellent lubricity and durability, and the resulting crepe paper has excellent quality.

DESCRIPTION OF REFERENCE NUMERALS

1, Y cylindrical dryer
2, P1 paper body
3, D doctor blade
5, P2 crepe paper
6 wind-up roller
7 spray nozzle
8, 9 pressing roller
10 production apparatus
11 depression
12 crepe layer
13 cured thermosetting polymer
13*a* inorganic solid lubricant
13*b* organic solid lubricant
51 thermally sprayed ceramic plate
55 load cell
56 doctor blade
57 motor

The invention claimed is:

1. A crepe agent composition for being applied to a surface of a cylindrical dryer, comprising:
- a lubricant including an inorganic solid lubricant;
- a dispersant for dispersing the lubricant;
- a thermosetting polymer for fixing the lubricant to the surface of the cylindrical dryer;
- and water as a solvent, wherein
- the thermosetting polymer is polyamide polyamine epichlorohydrin,
- the inorganic solid lubricant is boron nitride or silicon nitride,
- the dispersant is a polyamine resin,
- the lubricant has a particle diameter of 0.5 to 20 μm,
- the crepe agent composition includes the inorganic solid lubricant in an amount of 0.1 to 1.0 mass %, the dispersant in an amount of 0.01 to 0.2 mass %, and the thermosetting polymer in an amount of 0.1 to 30 mass %,
- the proportions of the inorganic solid lubricant and the thermosetting polymer are in a mass ratio of 1:10 to 150, and
- the lubricant, the thermosetting polymer and the dispersant each contain a nitrogen atom.

2. A crepe agent composition for being applied to a surface of a cylindrical dryer, comprising:
- a lubricant including an organic solid lubricant;
- a dispersant for dispersing the lubricant;
- a thermosetting polymer for fixing the lubricant to the surface of the cylindrical dryer;
- and water as a solvent, wherein
- the thermosetting polymer is polyamide polyamine epichlorohydrin,
- the organic solid lubricant is melamine cyanurate,
- the dispersant is a polyamine resin,
- the lubricant has a particle diameter of 0.5 to 20 μm, the crepe agent composition includes the organic solid lubricant in an amount of 0.1 to 5.0 mass %, the dispersant in an amount of 0.01 to 1.0 mass % and the thermosetting polymer in an amount of 0.1 to 30 mass %, the proportions of the organic solid lubricant and the thermosetting polymer are in a mass ratio of 1:2 to 30, and the lubricant, the thermosetting polymer and the dispersant each contain a nitrogen atom.

3. A crepe agent composition for being applied to a surface of a cylindrical dryer, comprising:

a lubricant including an organic solid lubricant and an inorganic solid lubricant;

a dispersant for dispersing the lubricant;

a thermosetting polymer for fixing the lubricant to the surface of the cylindrical dryer;

and water as a solvent, wherein the thermosetting polymer is polyamide polyamine epichlorohydrin, the inorganic solid lubricant is boron nitride or silicon nitride, the organic solid lubricant is melamine cyanurate, the dispersant is a polyamine resin, the lubricant having a particle diameter of 0.5 to 20 μm, the crepe agent composition includes the organic solid lubricant in an amount of 0.1 to 5.0 mass %, the inorganic solid lubricant in an amount of 0.1 to 1.0 mass %, the dispersant in an amount of 0.02 to 1.2 mass %, and the thermosetting polymer in an amount of 0.1 to 30 mass %, the proportions of the organic solid lubricant and the inorganic solid lubricant are in a mass ratio of 1 to 10:1, and the lubricant, the thermosetting polymer and the dispersant each contain a nitrogen atom.

4. A crepe agent composition according to claim 1, wherein the thermosetting polymer is cured by heat of the cylindrical dryer, and a crepe layer is formed on the surface of the cylindrical dryer.

5. A crepe agent composition according to claim 2, wherein the thermosetting polymer is cured by heat of the cylindrical dryer, and a crepe layer is formed on the surface of the cylindrical dryer.

6. A crepe agent composition according to claim 3, wherein the thermosetting polymer is cured by heat of the cylindrical dryer, and a crepe layer is formed on the surface of the cylindrical dryer.

7. A crepe agent composition according to claim 1, wherein the highest tolerable temperature of the inorganic solid lubricant is 500° C. or more, and the inorganic solid lubricant has a friction coefficient of 0.002 to 0.30.

8. A crepe agent composition according to claim 3, wherein the highest tolerable temperature of the inorganic solid lubricant is 500° C. or more, and the inorganic solid lubricant has a friction coefficient of 0.002 to 0.30.

9. A crepe agent composition according to claim 2, wherein the highest tolerable temperature of the organic solid lubricant is 200° C. or more, and the organic solid lubricant has a friction coefficient of 0.002 to 0.30.

10. A crepe agent composition according to claim 3, wherein the highest tolerable temperature of the organic solid lubricant is 200° C. or more, and the organic solid lubricant has a friction coefficient of 0.002 to 0.30.

* * * * *